US009704621B2

(12) United States Patent
Ogawa et al.

(10) Patent No.: US 9,704,621 B2
(45) Date of Patent: Jul. 11, 2017

(54) CHIP RESISTOR

(71) Applicant: ROHM CO., LTD., Kyoto-shi, Kyoto (JP)

(72) Inventors: Shinsuke Ogawa, Kyoto (JP); Makoto Toyonaga, Kyoto (JP)

(73) Assignee: ROHM CO., LTD., Kyoto (JP)

( * ) Notice: Subject to any disclaimer, the term of this patent is extended or adjusted under 35 U.S.C. 154(b) by 217 days.

(21) Appl. No.: 14/472,650

(22) Filed: Aug. 29, 2014

(65) Prior Publication Data

US 2015/0061819 A1 Mar. 5, 2015

(30) Foreign Application Priority Data

Aug. 30, 2013 (JP) ..... 2013-179339

(51) Int. Cl.

| | |
|---|---|
| ***H01C 10/00*** | (2006.01) |
| ***H01C 1/142*** | (2006.01) |
| ***H01C 1/148*** | (2006.01) |
| ***H01C 7/00*** | (2006.01) |
| ***H01C 17/00*** | (2006.01) |
| ***H01C 17/24*** | (2006.01) |

(52) U.S. Cl.

CPC ..... *H01C 1/142* (2013.01); *H01C 1/148* (2013.01); *H01C 7/003* (2013.01); *H01C 17/006* (2013.01); *H01C 17/24* (2013.01)

(58) Field of Classification Search

CPC ..... H01C 10/22; H01C 1/142
USPC ..... 338/195, 307, 309
See application file for complete search history.

(56) References Cited

U.S. PATENT DOCUMENTS

| | | | | |
|---|---|---|---|---|
| 5,680,092 | A * | 10/1997 | Yamada | H01C 7/006 338/308 |
| 6,462,304 | B2 * | 10/2002 | Kaida | H01C 17/242 219/121.69 |
| 6,492,896 | B2 * | 12/2002 | Yoneda | H01C 7/18 338/195 |
| 6,943,662 | B2 * | 9/2005 | Tanimura | H01C 1/142 257/537 |
| 7,782,173 | B2 * | 8/2010 | Urano | H01C 1/012 338/307 |
| 9,336,931 | B2 * | 5/2016 | Tsai | H01C 1/142 |
| 2008/0211619 | A1 * | 9/2008 | Belman | H01C 1/034 338/309 |
| 2010/0201477 | A1 * | 8/2010 | Yang | H01C 1/032 338/309 |

FOREIGN PATENT DOCUMENTS

JP 2006-245218 9/2006

* cited by examiner

*Primary Examiner* — Kyung Lee
(74) *Attorney, Agent, or Firm* — Hamre, Schumann, Mueller & Larson, P.C.

(57) ABSTRACT

A chip resistor includes a base member, a resistive element formed on the base member, a first inner electrode held in contact with a first end portion or the resistive element, a second inner electrode held in contact with a second end portion of the resistive element, a first reverse surface electrode reaching a first end portion of the base member, and a second reverse surface electrode reaching a second end portion of the base member. The length of the first and the second reverse surface electrodes is in a range of 2/10 to 3/10 of the length of the base member. Also, the length of the first and the second reverse surface electrodes is greater than the length of the first and the second inner electrodes.

15 Claims, 13 Drawing Sheets

CHIP RESISTOR

BACKGROUND OF THE INVENTION

1. Field of the Invention

The present invention relates to a chip resistor.

2. Description of the Related Art

A conventional chip resistor is disclosed, for example, in JP-A-2006-245218. This chip resistor includes a chip-shaped insulating base member, two upper electrodes formed en the upper surface of the base member, and a resistive element bridging between the two upper electrodes. Each upper electrode is made up of an inner electrode (formed directly on the upper surface of the base member) and an auxiliary electrode formed to cover the inner electrode. The resistive element has two ends disposed upon the two inner electrodes, respectively, which shows that the resistive element is formed after the inner electrodes are formed. The conventional chip resistor also includes an undercoat and an overcoat for covering the resistive element.

In the field of chip resistors, the downsizing of the products has been required, while improvement of the anti-surge properties is also required. Generally, the anti-surge properties tend to deteriorate as the chip size (hence the volume of the resistive element) becomes small. Conventionally, no consideration has been given to improvement of the anticipated-surge properties with respect to downsized chip resistors of the same type as the above-mentioned conventional chip resistor disclosed in JP-A-2006-245218.

SUMMARY OF THE INVENTION

The present invention has been proposed under the circumstances described above. It is therefore an object of the present invention to provide a chip resistor configured to exhibit improved anti-surge properties even when it is downsized.

According to a first aspect of the present invention, a chip resistor is provided with: a base member including an obverse surface and a reverse surface opposite to the obverse surface, while also including a first end portion and a second end portion spaced apart from each other in a first direction; a resistive element formed on the obverse surface and including a first end portion and a second end portion spaced apart from each other in the first direction; a first inner electrode formed on the obverse surface and held in contact with the first end portion of the resistive element; a second inner electrode formed on the obverse surface and held in contact with the second end portion of the resistive element; a first reverse surface electrode formed on the reverse surface and reaching the first end portion of the base member; and a second reverse surface electrode formed on the reverse surface and spaced apart from the first reverse surface, the second reverse surface electrode reaching the second end portion of the base member. The length of each of the first reverse surface electrode and the second reverse surface electrode measured in the first direction is in a range of 2/10 to 3/10 of the length of the base member measured in the first direction. Further the above-noted length of each of the first reverse surface electrode and the second reverse surface electrode is greater than the length of each of the first inner electrode and the second inner electrode measured in the first direction.

Preferably, the first inner electrode includes a part overlapping on the first end portion of the resistive element such that the length of the above-noted part of the first inner electrode measured in the first direction is not greater than 1/14 of the length of the resistive element measured in the first direction, and the second inner electrode includes a part overlapping on the second end portion of the resistive element such that the length of the above-noted part of the second inner electrode measured in the first direction is not greater than 1/14 of the length of the resistive element measured in the first direction.

Preferably, the first inner electrode reaches the first end portion of the base member, and the first inner electrode includes both a part overlapping on the first end portion of the resistive element and the remaining part. The length of the remaining part measured in the first direction is not greater than 1/16 of the length of the base member measured in the first direction. Likewise, the second inner electrode reaches the second end portion of the base member, and the second inner electrode includes both a part overlapping on the second end portion of the resistive element and the remaining part. The length of the remaining part of the second inner electrode measured in the first direction is not greater than 1/16 of the length of the base member measured in the first direction.

Preferably, the resistive element has a width measured in a second direction perpendicular to the first direction is in a range of 1/2 to 9/10 of the width of the obverse surface measured in the second direction.

Preferably, the chip resistor of the first aspect further includes an undercoat for covering the resistive element.

Preferably, the chip resistor still further includes an overcoat for covering the undercoat.

Preferably, the chip resistor of the first aspect further includes a first groundwork electrode and a second groundwork electrode each held in contact with the overcoat. The first groundwork electrode covers the first inner electrode, and the second groundwork electrode covers the second inner electrode.

Preferably, the base member includes a first side surface and a second side surface spaced apart from each other in the first direction, where the first groundwork electrode is formed on the first side surface, and the second groundwork electrode is formed on the second side surface.

Preferably, the first reverse surface electrode is electrically connected to the first groundwork electrode, and the second reverse surface electrode is electrically connected to the second groundwork electrode.

Preferably, the chip resistor of the first aspect further includes a first plating electrode and a second plating electrode, where the first plating electrode covers both the first groundwork electrode and the first reverse surface electrode, and the second plating electrode covers both the second groundwork electrode and the second reverse surface electrode.

Preferably, the length of the base member measured in the first direction is in a range of 1.0 to 3.2 mm, and the width of the base member measured in a second direction perpendicular to the first direction is in a range of 0.5 to 2.5 mm.

Preferably, the resistive element is formed with a trimming groove.

Preferably, the trimming groove includes a main portion and an additional portion, where the main portion extends from an initial point to a midway point (the initial point is set at an edge of the resistive element, and the midway point is offset with respect to the initial point, in both the first direction and the second direction), and the additional portion extends from the midway point to an ending point that is offset from the midway point toward the initial point in the second direction.

Preferably, the additional portion extends at an angle of not greater than 90° with respect to the main portion.

Preferably, the main portion has an L-shaped form that includes a first portion extending from the initial point in the second direction, and a second portion extending from an end of the first portion in the first direction.

According to a second aspect of the present invention, a chip resistor is provided with: a base member including an obverse surface, a first end portion and a second end portion spaced apart from the first end portion in a first direction; a resistive element formed on the obverse surface and including a first end portion and a second end portion spaced apart from each other in the first direction; a first inner electrode formed on the obverse surface and held in contact with the first end portion of the resistive element; a second inner electrode formed on the obverse surface and held in contact with the second end portion of the resistive element; and a trimming groove formed in the resistive element. The trimming groove includes a main portion and an additional portion, where the main portion extends from an initial point to a midway point (the initial point is set at an edge of the resistive element, and the midway point is offset with respect to the initial point in both the first direction and a second direction perpendicular to the first direction), and the additional portion extends from the midway point to an ending point that is offset from the midway point toward the initial point in the second direction.

Preferably, the length of the base member measured in the first direction is in a range of 1.0 to 3.2 mm, and the width of the base member measured in the second direction is in a range of 0.5 to 2.5 mm.

Preferably, the additional portion extends at an angle of no greater than 90° with respect to the main portion.

Preferably, the main portion has an L-shaped form that includes a first portion extending from the initial point in the second direction, and a second portion extending from an end of the first portion in the first direction.

Preferably, the chip resistor of the second aspect further includes an undercoat for covering the resistive element.

Preferably, the chip resistor of the second aspect still further includes an overcoat for covering the undercoat.

Preferably, the chip resistor of the second aspect further includes a first groundwork electrode and a second groundwork electrode each held in contact with the overcoat, where the first groundwork electrode covers the first inner electrode, and the second groundwork electrode covers the second inner electrode.

Preferably, the base member includes a first side surface and a second side surface spaced apart from each other in the first direction, and the first groundwork electrode is formed on the first side surface, while the second groundwork electrode is formed on the second side surface.

Preferably, the chip resistor of the second aspect further includes a first reverse surface electrode and a second reverse surface electrode, the base member includes a reverse surface opposite to the main surface, and each of the first reverse surface electrode and the second reverse surface electrode is formed on the reverse surface. The first reverse surface electrode is electrically connected to the first groundwork electrode, while the second reverse surface electrode is electrically connected to the the second groundwork electrode.

Preferably, the chip resistor of the second aspect further includes a first plating electrode and a second plating electrode, where the first plating electrode covers the first groundwork electrode and the first reverse surface electrode, while the second plating electrode covers the second groundwork electrode and the second reverse surface electrode.

Other features and advantages of the present invention will become more apparent from detailed description given below with reference to the accompanying drawings.

DETAILED DESCRIPTION OF THE PREFERRED EMBODIMENTS

Figure 1:
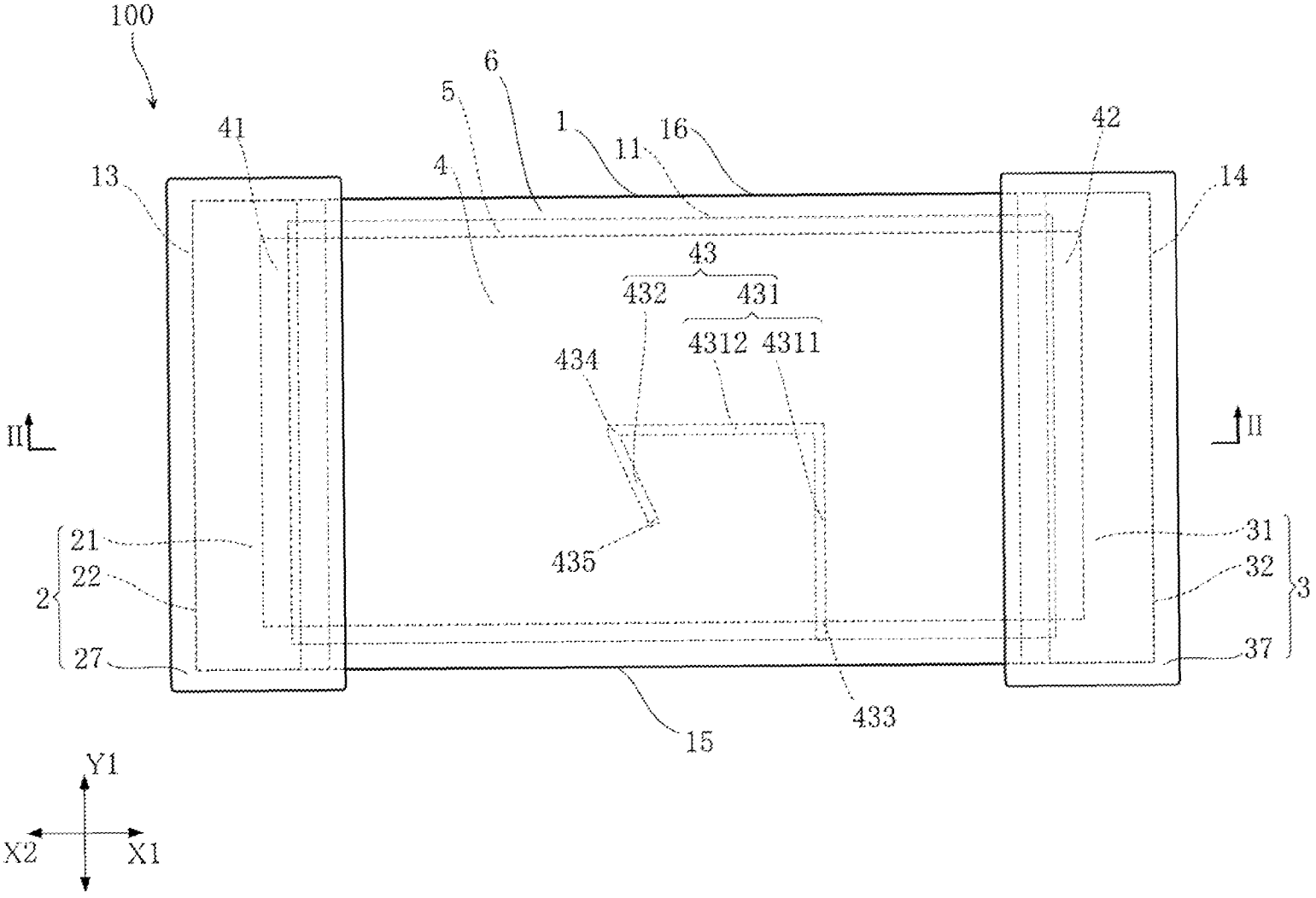
FIG. 1 is a plan view (partly seen through) showing a chip resistor according to an embodiment of the present invention.
Figure 2:
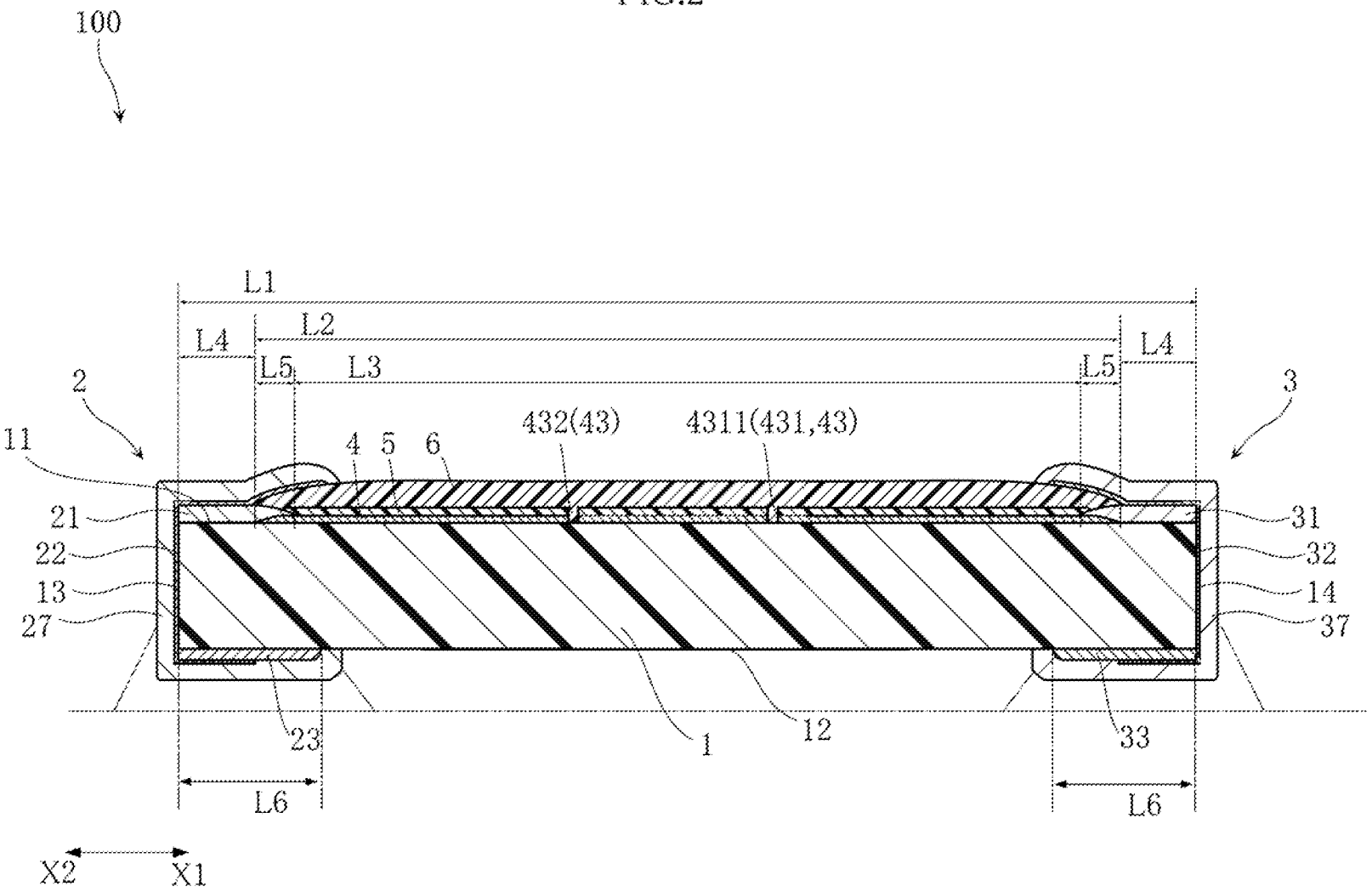
FIG. 2 is a sectional view taken along the II-II line of FIG. 1.

FIG. 1 is a plane view of a chip resistor 100 according to an embodiment of the present invention. FIG. 2 is a sectional view taken along II-II line of FIG. 1.

The chip resistor 100 includes a base member 1, a first electrode 2, a second electrode 3, a resistive element 4, an undercoat 5 and an overcoat 6. The length (measured in the lateral direction of FIG. 1) of base member 1 is, for example, about in a range of 1.0 to 3.2 mm, for example, and the width (measured in the vertical direction of FIG. 1) of the base member 1 is about in a range of 0.5 to 2.5 mm, for example. The thickness (measured in the vertical direction of FIG. 2) of the base member 1 is about in a range of 0.2 to 0.5 mm, for example.

The base member 1 is made of an insulating material. The insulating material may be ceramic (such as alumina), for example. In the illustrated example, the base member 1 is in form of a cuboid. The base member 1 includes a main surface 11, a reverse surface 12, a first side surface 13, a second side surface 14, a third side surface 15 and a fourth side surface 16. These six side surfaces are all flat.

The main surface 11 and the reverse surface 12 face in mutually opposite directions. Each of the first through the fourth side surfaces 13-16 is connected to both the main surface 11 and the reverse surface 12, The first side surface 13 and the second side surface 14 face opposite to each other in a first direction (X1-X2 direction). The third side surface 15 and the fourth side surface 16 face opposite to each other in a second direction (Y1 direction) perpendicular to the first direction.

The base member 1 includes a first end portion and a second end portion spaced apart from each other in the first direction, and the first electrode 2 and the second electrode 3 are formed on the first end portion and the second end portion, respectively.

Figure 10:
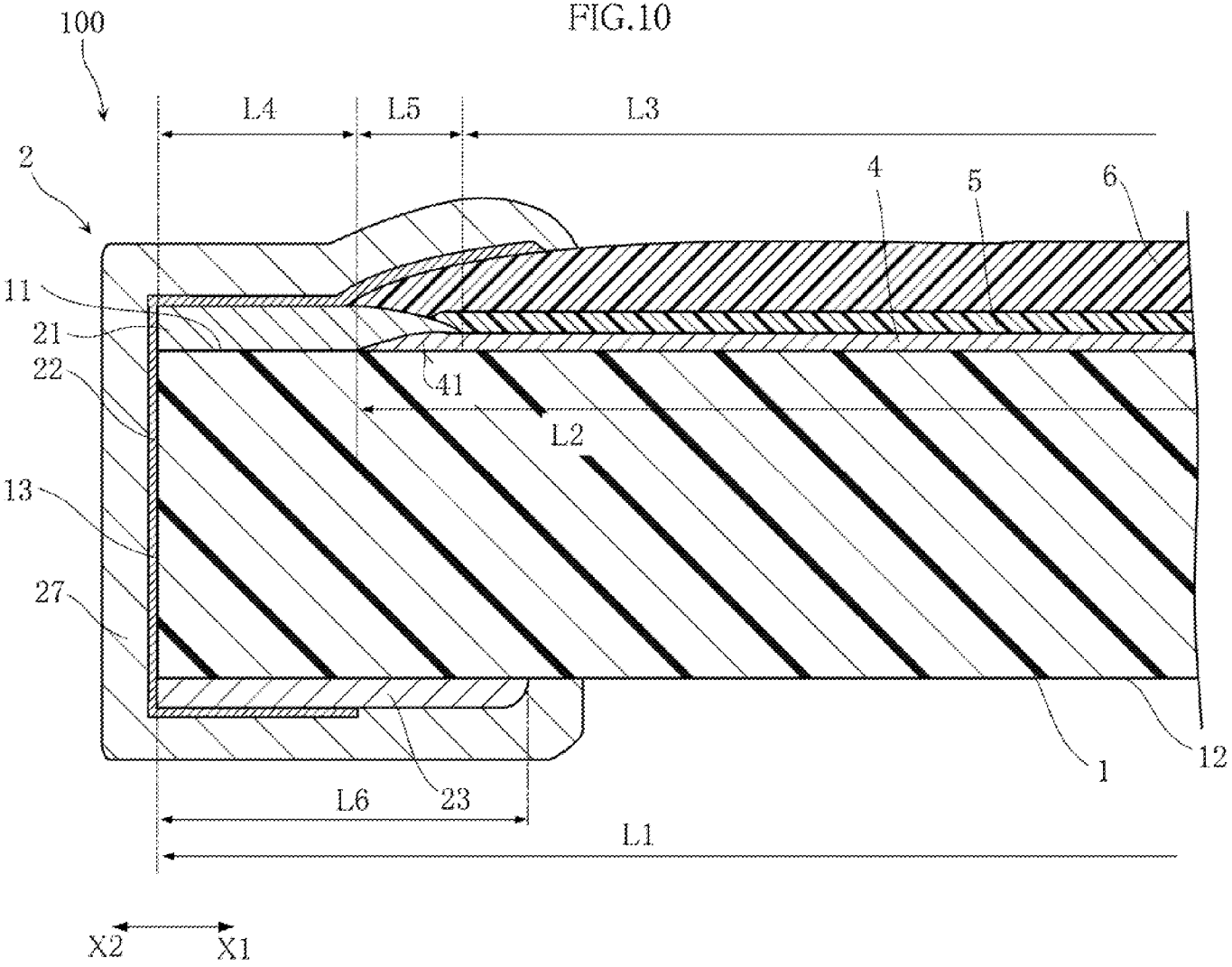
FIG. 10 is a partial expanded sectional view of the chip resistor shown in FIG. 2.

As shown in FIGS. 1, 2 and 10, the first electrode 2 includes a first inner electrode 21, a first groundwork electrode 22, a first reverse surface electrode 23 and a first plating electrode 27.

The first inner electrode 21 is formed on the main surface 11 of the base member 1. In the present embodiment, the first inner electrode 21 extends to (i.e., reaches) the boundary between the main surface 11 and the first side surface 13. The first inner electrode 21 includes an end face that is flush with the first side surface 13. The first inner electrode 21 is made, for example, of a silver-based metal glaze material. In the present embodiment, the first inner electrode 21 is formed by printing and burning of the material, and has a thickness of 10 to 30 μm, for example.

The first groundwork electrode 22 is formed, at least, on the first side surface 13 of the base member 1. In the present embodiment, the first groundwork electrode 22 covers the entirety of the first side surface 13. The first groundwork electrode 22 is made of Ni or Cr, for example. In the present embodiment, the first groundwork electrode 22 is formed by sputtering, and has a thickness of 20 to 200 nm, for example. Alternatively, the first groundwork electrode 22 may be formed by printing. The first groundwork electrode 22 is held in contact with the first inner electrode 21, thereby being electrically connected to the first inner electrode 21. In the present embodiment, the first groundwork electrode 22 is formed to collectively cover the first inner electrode 21, part of the overcoat 6, the first side surface 13 of the base member 1 and the first reverse surface electrode 23. The first groundwork electrode 22 serves as an undercoating layer for forming the first plating electrode 27. As shown in FIG. 10, the top surface of the first inner electrode 21 includes part covered by the overcoat 6 or the undercoat 5 and the remaining part ("exposed part" not covered by the overcoat 6 nor the undercoat 5). The first groundwork electrode 22 covers the exposed part of the first inner electrode 21. Also, the first groundwork electrode 22 covers only part of the lower surface of the first reverse surface electrode 23.

The first reverse surface electrode 23 is formed on the reverse surface 12 of the base member 1. The first reverse surface electrode 23 extends to the boundary between the reverse surface 12 and the first side surface 13. In the present embodiment, the first reverse surface electrode 23 is made of a silver-based metal glaze material. In the present embodiment, the first reverse surface electrode 21 is formed by printing and burning of the material. The first reverse surface electrode 23 is held in contact with the first groundwork electrode 22, thereby being electrically connected to the first groundwork electrode 22.

Figure 11:
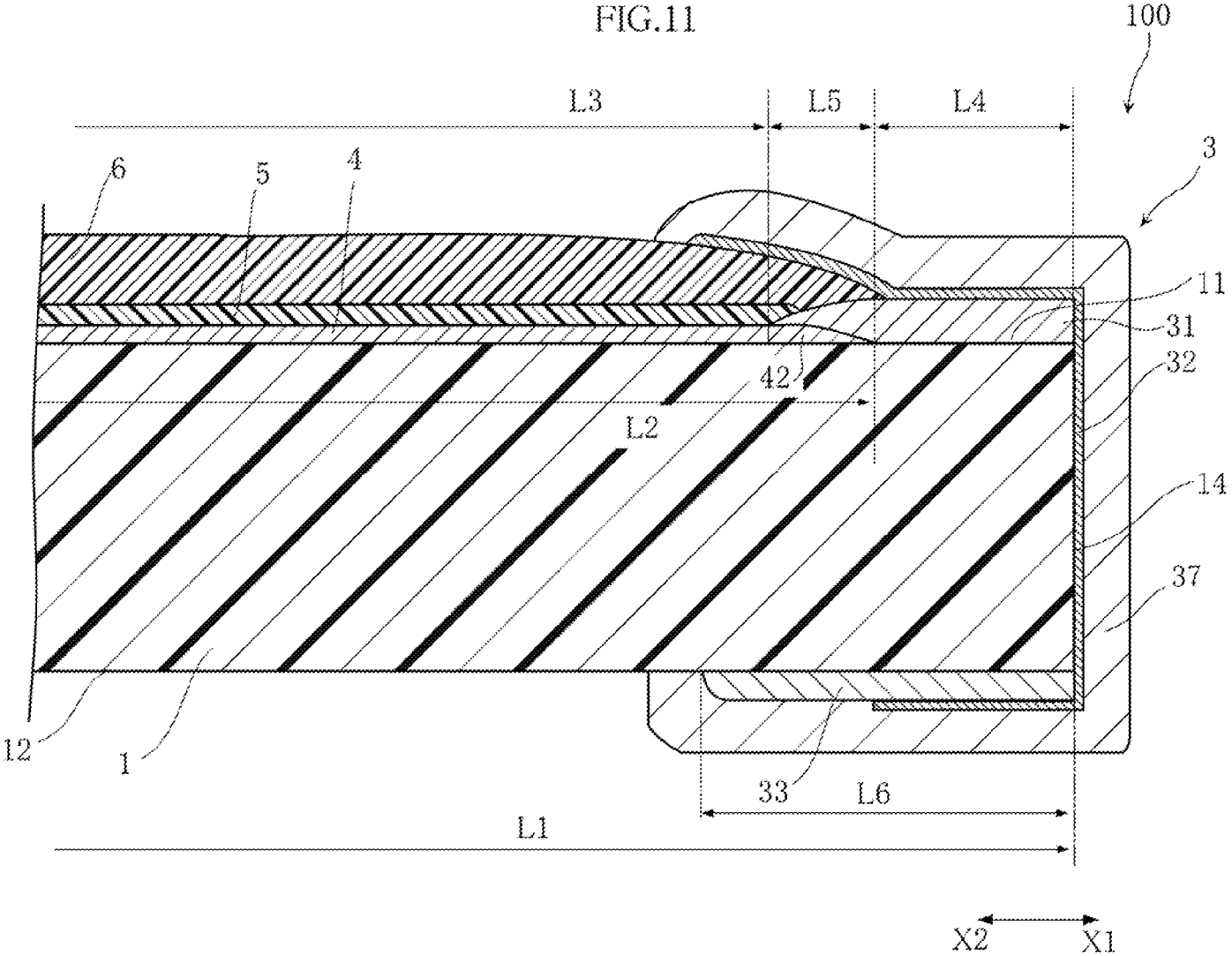
FIG. 11 a partial expanded sectional view of the chip resistor shown in FIG. 2.

As shown in FIGS 1, 2 and 11, the second electrode 3 includes a second inner electrode 31, a second groundwork electrode 32, at second reverse surface electrode 33 and a second plating electrode 37.

The second inner electrode 31 is formed on the main surface 11 of the base member 1. In the present embodiment, the second inner electrode 31 extends to the boundary between the main surface 11 and the second side surface 14. The second inner electrode 31 includes an end face that is flush with the second side surface 14. The second inner electrode 31 is made, for example, of a silver-based metal glaze material. In the present embodiment, the second inner electrode is formed by printing and burning of the material, and has a thickness of 10-30 μm, for example.

The second groundwork electrode 32 is formed, at least, on the second side surface 14 of the base member 1. In the present embodiment, the second groundwork electrode 32 covers the entirety of the second side surface 14. The second groundwork electrode 32 is made of Ni or Cr, for example. In the present embodiment, the second groundwork electrode 32 is formed by sputtering, and has a thickness is 20-200 nm, for example. Alternatively, the second groundwork electrode 32 may be formed by printing. The second groundwork electrode 32 is held in contact with the second inner electrode 31, thereby being electrically connected to the second inner electrode 31. In the present embodiment, the second groundwork electrode 32 is formed to collectively cover the second inner electrode 31, part of the overcoat 6, the second side surface 14 of the base member 1 and the second reverse surface electrode 33. The second groundwork electrode 32 serves as an undercoating layer for forming the second plating electrode 37. As shown in FIG. 11, the top surface of second, inner electrode 31 includes parts covered by the overcoat 6 or the undercoat 5 and the remaining part ("exposed part" not covered by the overcoat 6 nor the undercoat 5). The second groundwork electrode 32 covers the exposed part of the second inner electrode 31. Also, the second groundwork electrode 22 covers only a part of the lower surface of the second reverse surface electrode 23.

The second reverse surface electrode 33 is formed on the reverse surface 12 of the base member 1. The second reverse surface electrode 33 extends to the boundary between the reverse surface 12 and the second side surface 14. In the present embodiment, the second reverse surface electrode 33 is made of a silver-based metal glaze material, for example. In the present embodiment, the second reverse surface electrode 33 is formed by printing and burning of the material. The second reverse surface electrode 33 is held in contact with the second groundwork electrode 32, thereby being electrically connected to the second groundwork electrode 32.

The resistive element 4 is formed on the main surface 11 of the base member 1 and is electrically connected to both the first inner electrode 21 and the second inner electrode 31. Specifically, the resistive element 4 includes a first end portion 41 and a second end portion 42 spaced apart from each other in the first direction X1-X2. As shown in FIGS. 10 and 11, the first end portion 41 creeps in under the first inner electrode 21, and the second end portion 42 creeps in under the second inner electrode 31. As understood from this configuration, the resistive element 4 is formed on the main surface 11 prior to the first inner electrode 21 and the second inner electrode 31. The resistive element 4 is made of a resistive material such as oxidation ruthenium, for example. The resistive element 4 is formed, for example, by printing and burning of the material, and has a thickness of 10-30 μm, for example.

According to the present embodiment, the effective length L3 (see FIG. 2, for example) of the resistive element 4 can be advantageously increased, and its width W2 (see FIG. 4) can also be advantageously increased. Specifically, in the first direction, each of the first inner electrode 21 and the second inner electrode 31 includes a part (of length L4) which does not overlap with the resistive element 4. Length L4 maybe in a range of 1/64 to 1/16 of length L1 of the base member 1, preferably in a range of 1/20 to 1/16 of length L1. Also, each of the first inner electrode 21 and the second inner electrode 31 includes a part (of length L5) which overlaps with the resistive element 4. Length L5 may be not greater than 1/14 of the length L2 of the resistive element 4, preferably not greater than 1/60 of the length L2. The width W2 of the resistive element 4 may be in a range of 1/2 to 9/10 of the width W1 of the base member 1 (see FIG. 4), preferably in a range of 3/5 to 4/5 of the width W1. The first reverse surface electrode 23 and the second reverse surface electrode 33 may preferably have a sufficient length L6 (measured in the first direction X1-X2) so as to ensure proper electrical conduction to a substrate on which that chip resistor 100 is to be mounted. The length L6 may be in a range of 2/10 to 3/10 of the length L1 of the base member 1. As a result, the length (L4+L5) of the first inner electrode 21 and the second inner electrode 31 can be advantageously shorter than the length L6 of the first reverse surface electrode 23 and the the second reverse surface electrode 33. For example, when the length L1 of the base member 1 is 1.6 mm (while the width is e.g. 0.8 mm), the length L6 may be 0.32 mm, the length L4 may be about 0.1 mm, the length 15 may be about 0.1 mm, and the sum of L4 and L5 may be about 0.2 mm.

Figure 3:
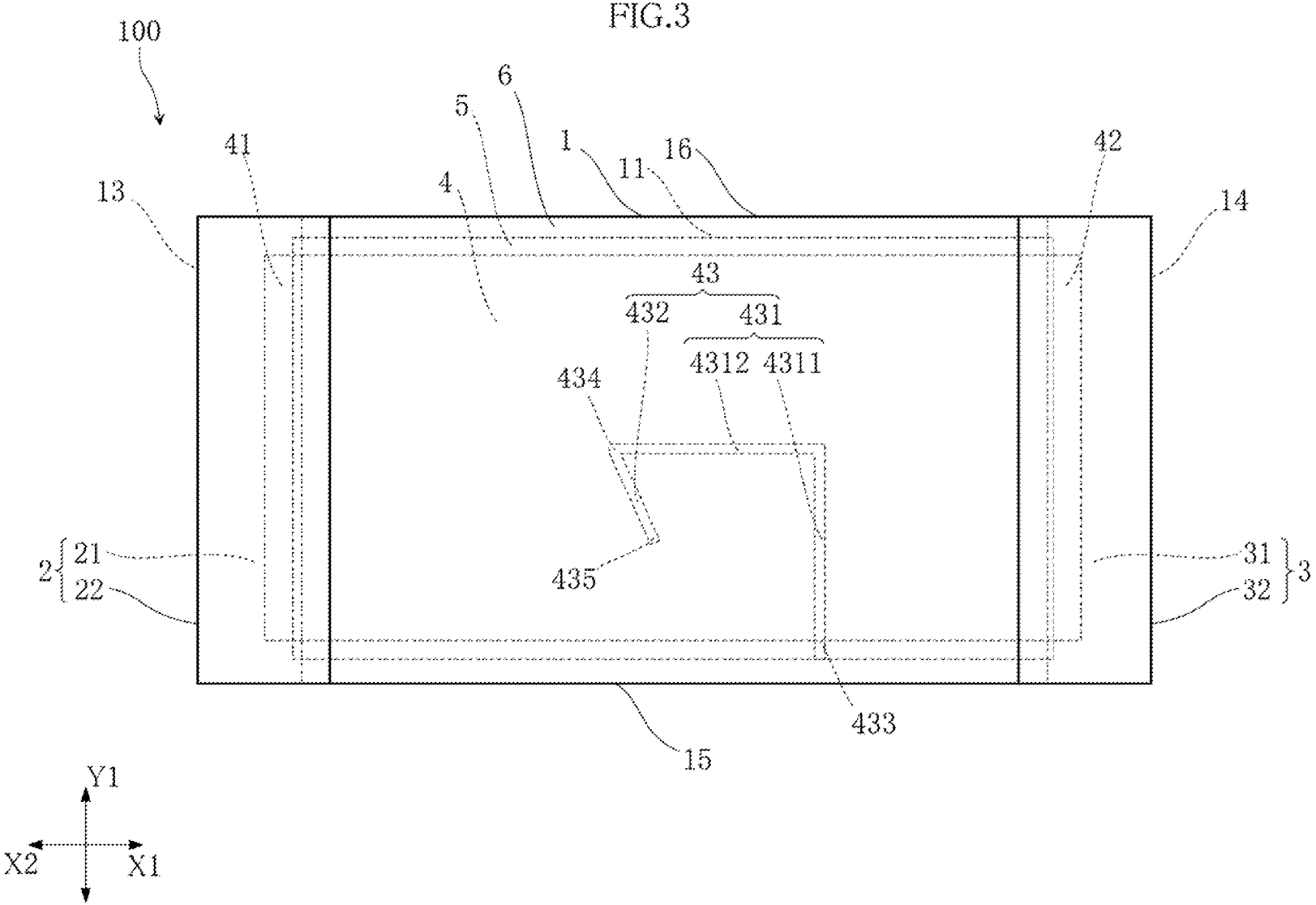
FIG. 3 is a plan view (partly seen through) corresponding to that of FIG. 1, with first and second plating electrodes omitted.

As shown in FIGS. 1-3, the undercoat 5, formed on the resistive element 4, is configured to cover the resistive element 4 entirely, i.e., for the full length and full width of the resistive element 4. The undercoat 5 includes two ends spaced apart from each other in the first direction X1-X2, and these ends contact with a part on the top surface of the first inner electrode 21 and the second inner electrode 31, respectively. Also, the undercoat 5 includes two ends (two edges) spaced apart from each other in the second direction (Y1 direction), and these ends contact with the main surface 11. The undercoat 5 is made of a glass material (such as borosilicate lead glass). The undercoat 5 may be formed by printing and burning of the material, and has a thickness of 5 to 50 μm, for example.

After the formation of the undercoat 5, a trimming groove 43 for resistance adjustment is formed in the resistive element 4 (see e.g. FIG. 1). As discussed below, the trimming groove 43 is formed by the irradiating of a laser beam.

As shown in FIGS. 1, 2, 10 and 11, the overcoat 6 is formed on the undercoat 5 to cover the undercoat 5. The overcoat 6 includes two ends spaced apart from each other in the first direction X1-X2, and these ends contact with a part of the top surface of the first inner electrode 21 and the second inner electrode 31, respectively. Also, the overcoat 6 includes two ends spaced apart from each other in the second direction (Y1 direction), and these ends contact with the main surface 11 and each extend to one of the edges (ends spaced apart from each other in the Y1 direction) of the main surface 11. The overcoat 6 is made of an insulating material (e.g., epoxy resin). The overcoat 6 may be formed by printing and drying of the material.

As shown in FIG. 10, the first plating electrode 27 constitutes the first electrode 2 together with the first inner electrode 21, the first groundwork electrode 22 and the first reverse surface electrode 23. The first plating electrode 27 may be formed by conducting plating processing with respect to the first groundwork electrode 22 once or a required number of times. In the present embodiment, the first plating electrode 27 covers, in addition to the first groundwork electrode 22, a part of the overcoat 6, a part of the first reverse surface electrode 23 (the part exposed from the first groundwork electrode 22) and a part of the reverse surface 12 of the base member 1 (see FIGS. 5 to 8). The first plating electrode 27 may be made of at least one of Cu, Au, Ni and Sn, and may have a thickness of 6 to 15 μm.

As shown in FIG. 11, the second plating electrode 37 constitutes the second electrode 3 together with the second inner electrode 31, the second groundwork electrode 32 and the second reverse surface electrode 33. The second plating electrode 37 may be formed by conducting plating processing with respect to the second groundwork electrode 32 once or a required number of times. In the present embodiment, the second plating electrode 37 covers, in addition to the second groundwork electrode 32, a part of the overcoat 6, a part of the second reverse surface electrode 33 and a part of the reverse surface 12 of the base member 1 (see FIGS. 5 to 7 and 9). The second plating electrode 37 may be made of at least one of Cu, Au, Ni and Sn, and may have a thickness of 6 to 15 μm.

The trimming groove 43 is formed, as noted above, to set the resistance value of the chip resistor 100 to a desired value. Specifically, for the resistance value setting, the resistive element 4 is irradiated by a laser beam emitted from outside of the undercoat 5, so that part of the resistive element 4 is to be burnt away while the resistance value between the first electrode 2 and the second electrode 3 is being monitored. During that process, the laser spot is moved along in a certain direction or directions to cause the resistive element 4 to have a groove suitable for providing the desired resistance.

Figure 4:
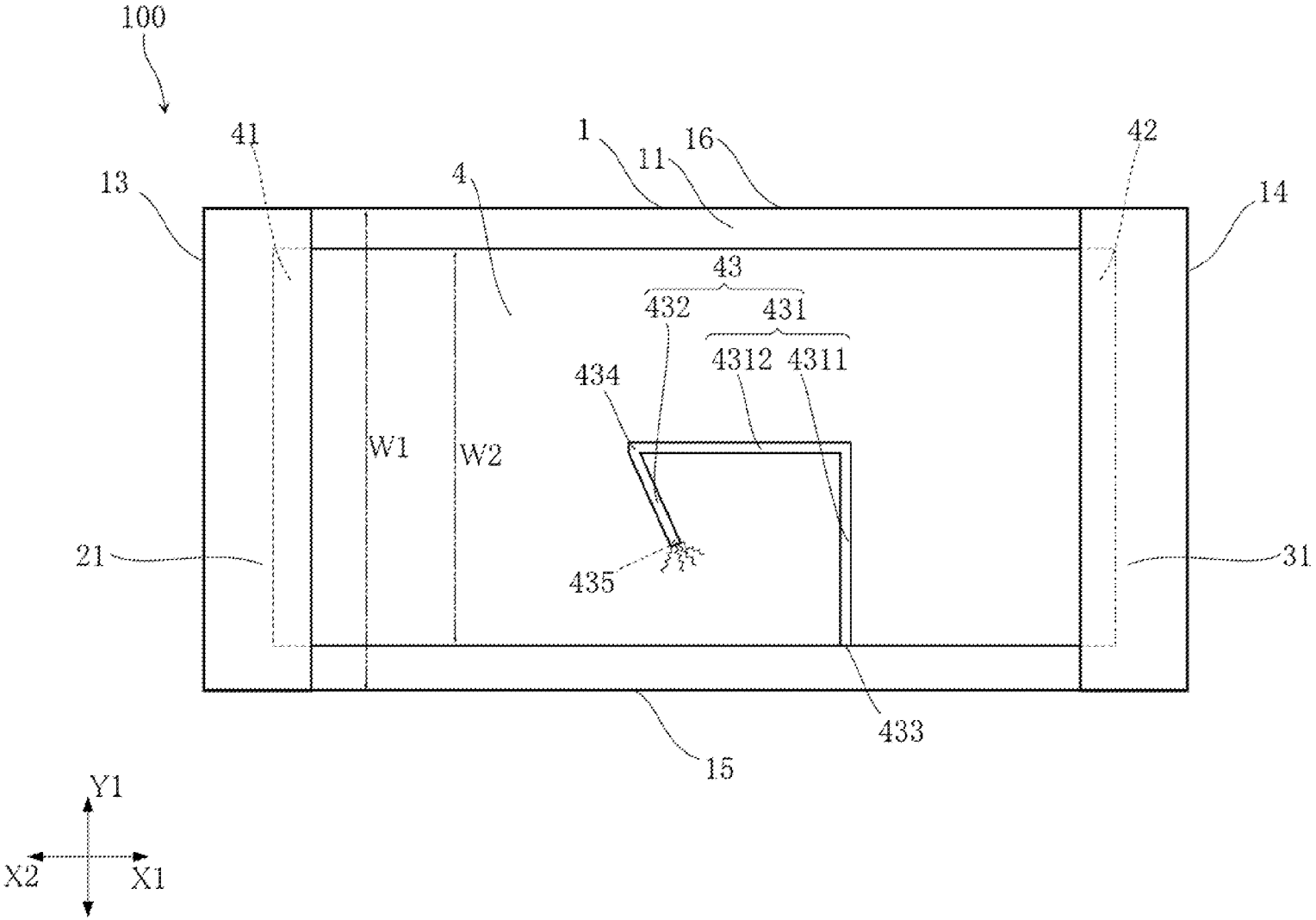
FIG. 4 is a plan view (partly seen through) corresponding to that of FIG. 3, with first and second groundwork electrodes, an undercoat and an overcoat omitted.
Figure 5:
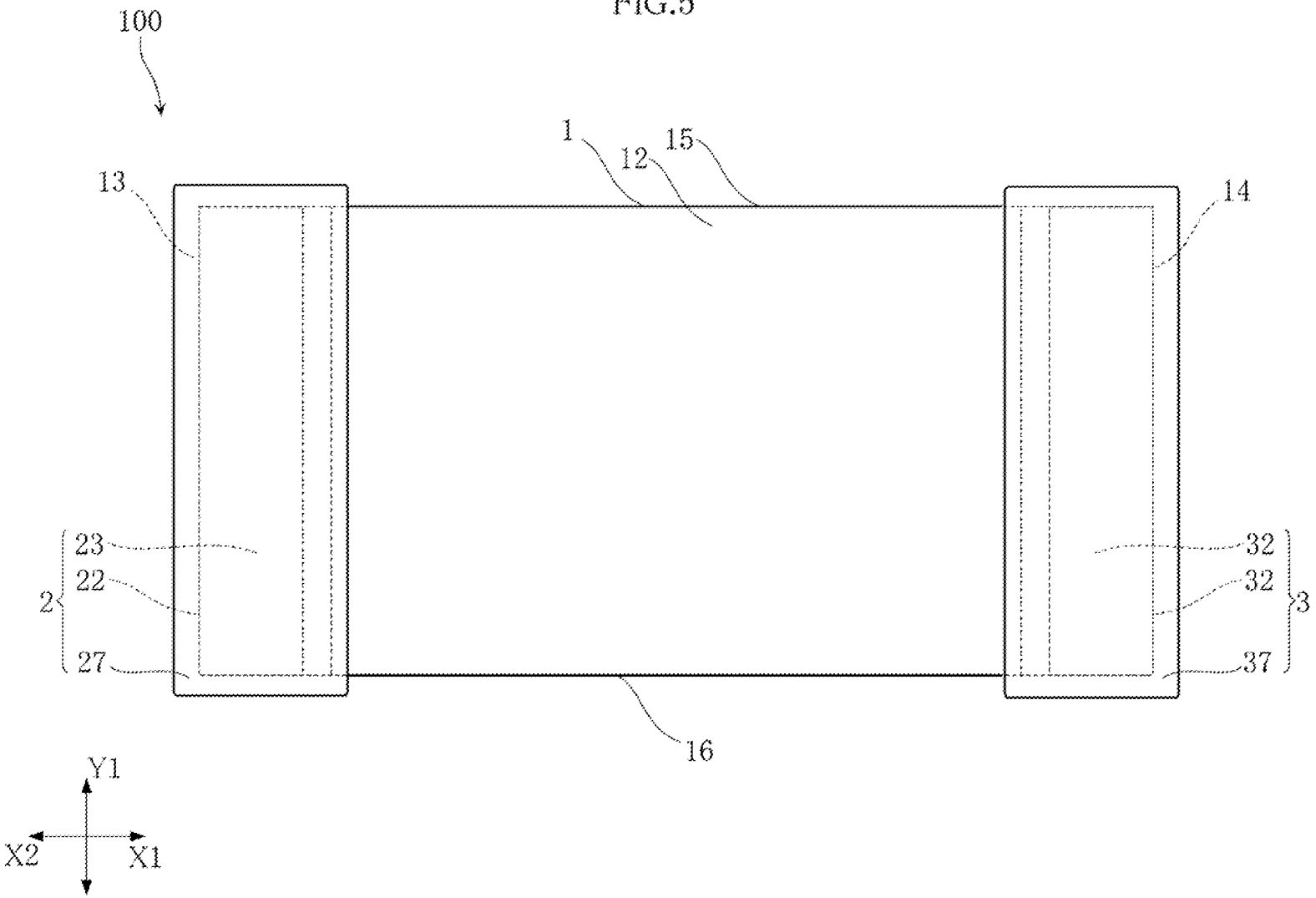
FIG. 5 is a bottom view (partly seen through) of the chip resistor shown in FIG. 1.
Figure 6:
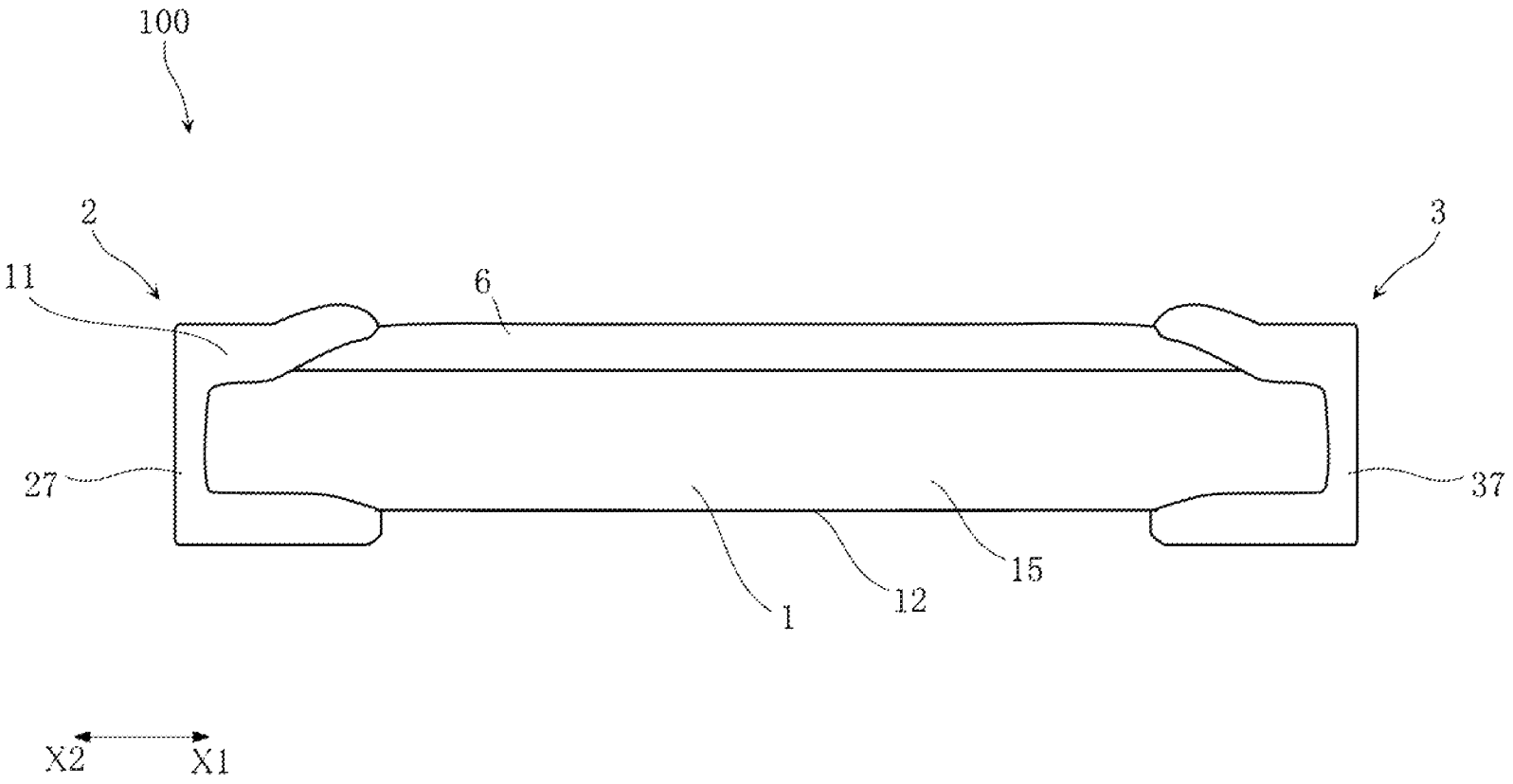
FIG. 6 is a front view showing the chip resistor of FIG. 1.
Figure 7:
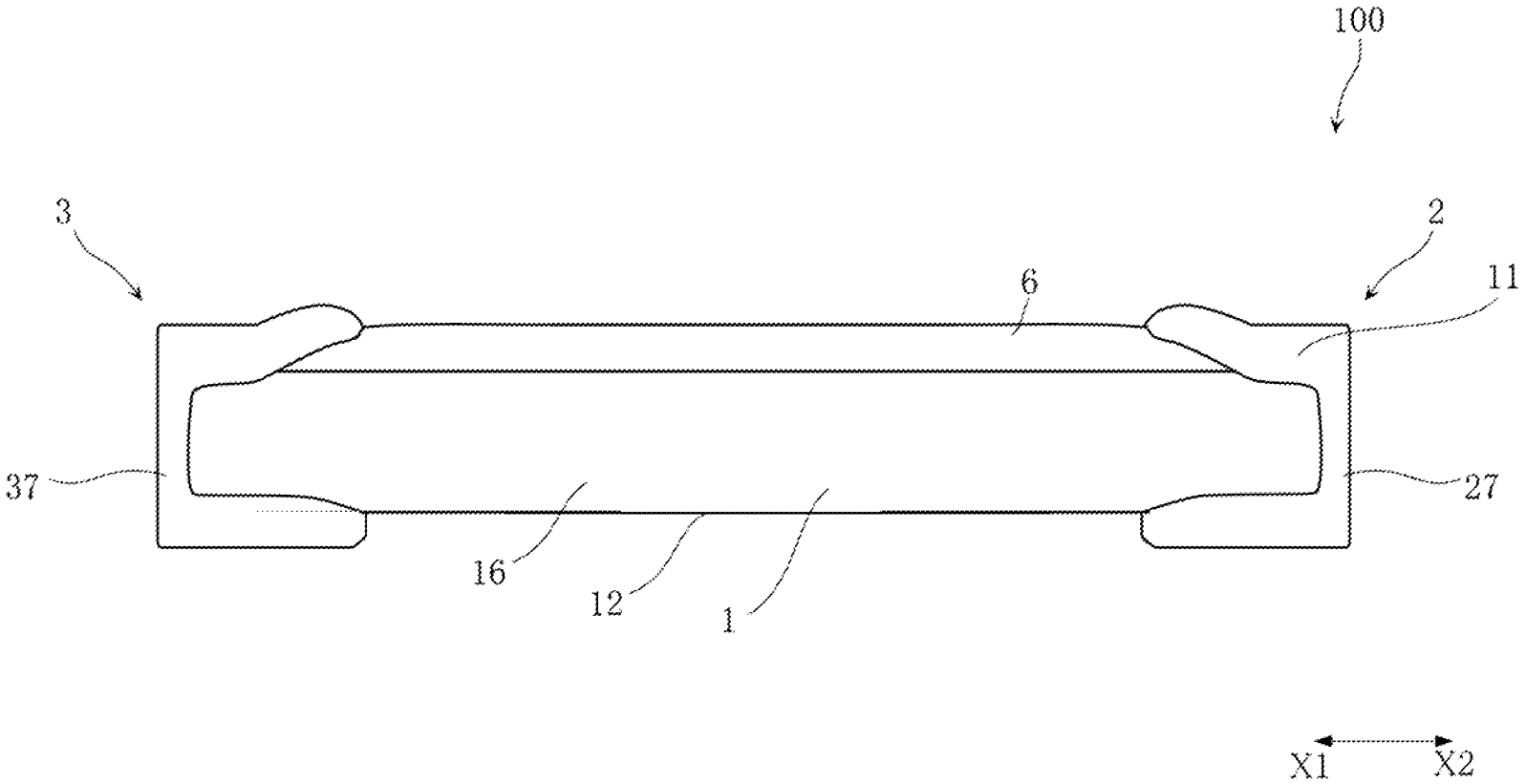
FIG. 7 is a rear view showing the chip resistor of FIG. 1.
Figure 8:
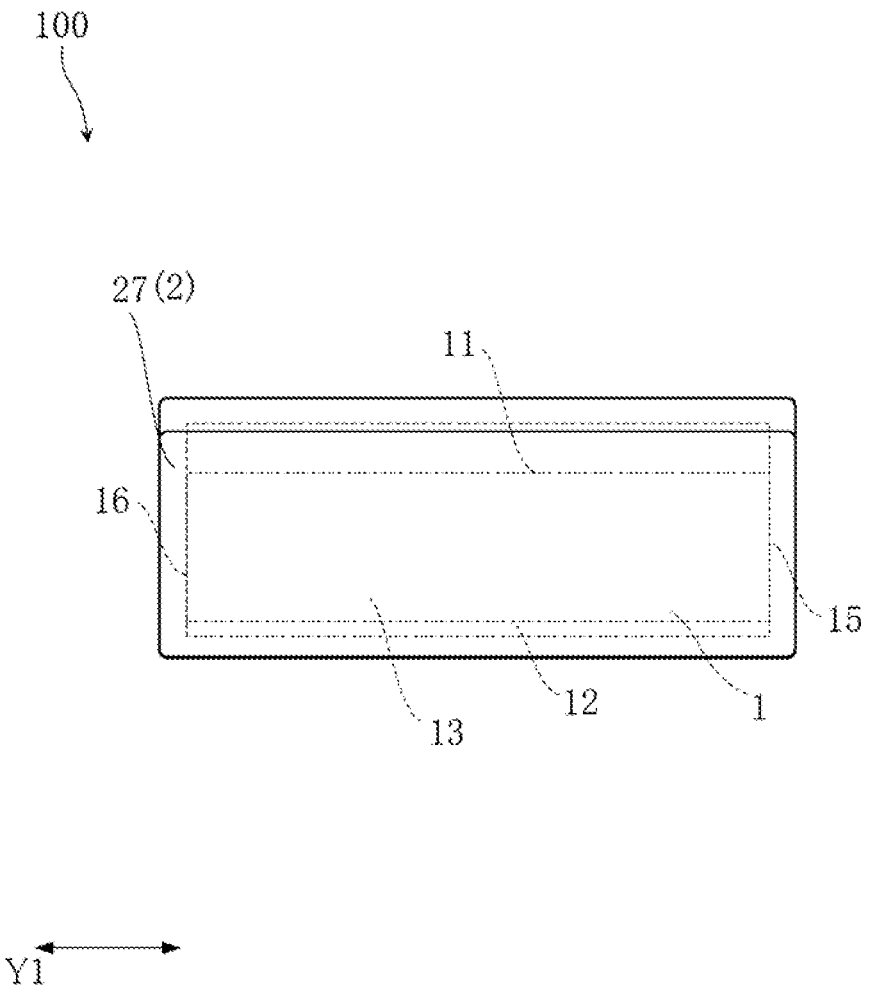
FIG. 8 is a left side view (partly seen through) showing the chip resistor of FIG. 1.
Figure 9:
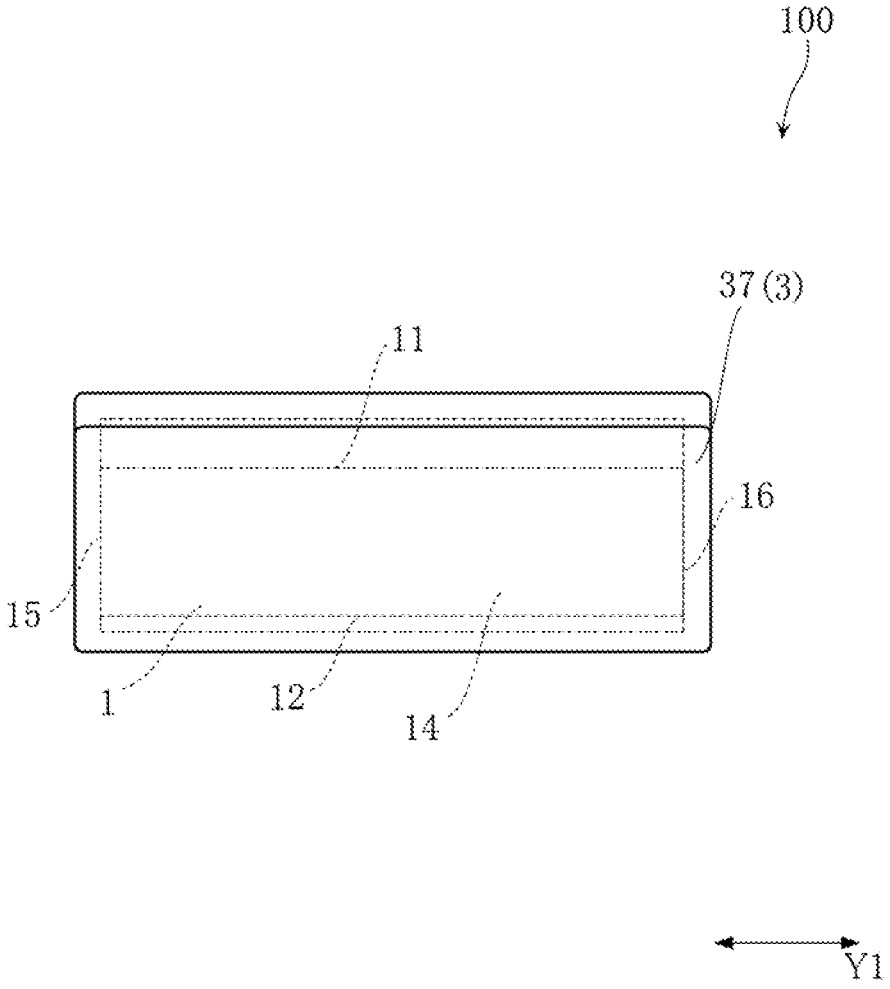
FIG. 9 is a right side view (partly seen through) showing the chip resistor of FIG. 1.

In the present embodiment, as shown in FIG. 4, the trimming groove 43 has an initial point 433, a midway point 434 and an ending point 435. The initial point 433 is set on one of the two edges (each extending in the first direction) of the resistive element 4, and located between the first electrode 2 and the second electrode 3 in the first direction. In the illustrated example, the initial point 433 is closer to the second inner electrode 31 than to the first inner electrode 21, The midway point 434 is offset with respect to the initial point 433 in both the first direction X1-X2 and the second direction Y1.

The trimming groove 43 includes a main section 431 extending from the initial point 433 to the midway point 434, and an additional section 432 extending from the midway point 434 to the ending point 435. In the illustrated example, the ending point 435 is offset with respect to the midway point 434 toward the initial point 433 in the first direction, while also being offset from the midway point 434 toward the initial point 433 in the second direction. Thus, the angle formed between the additional section 432 and the main section 431 is an acute angle (less than 90 degrees or 90°). The width of the trimming groove 43 is 15-40 μm, for example.

In the present embodiment, the main section 431 has an L-shaped form that includes a first straight portion 4311 extending from the initial point 433 in the second direction Y1, and a second straight portion 4312 extending from an end of the first straight portion 4311 in the first direction X1-X2. Rough adjustment of the resistance value is accomplished depending on the length of the first straight portion 4311, and fine adjustment of the resistance value is accomplished depending on the length of the second straight portion 4312.

The additional section 432 extends from the midway point 434 with an angle of 90° or less (e.g., 80°) with respect to the second straight portion 4312.

Figure 12:
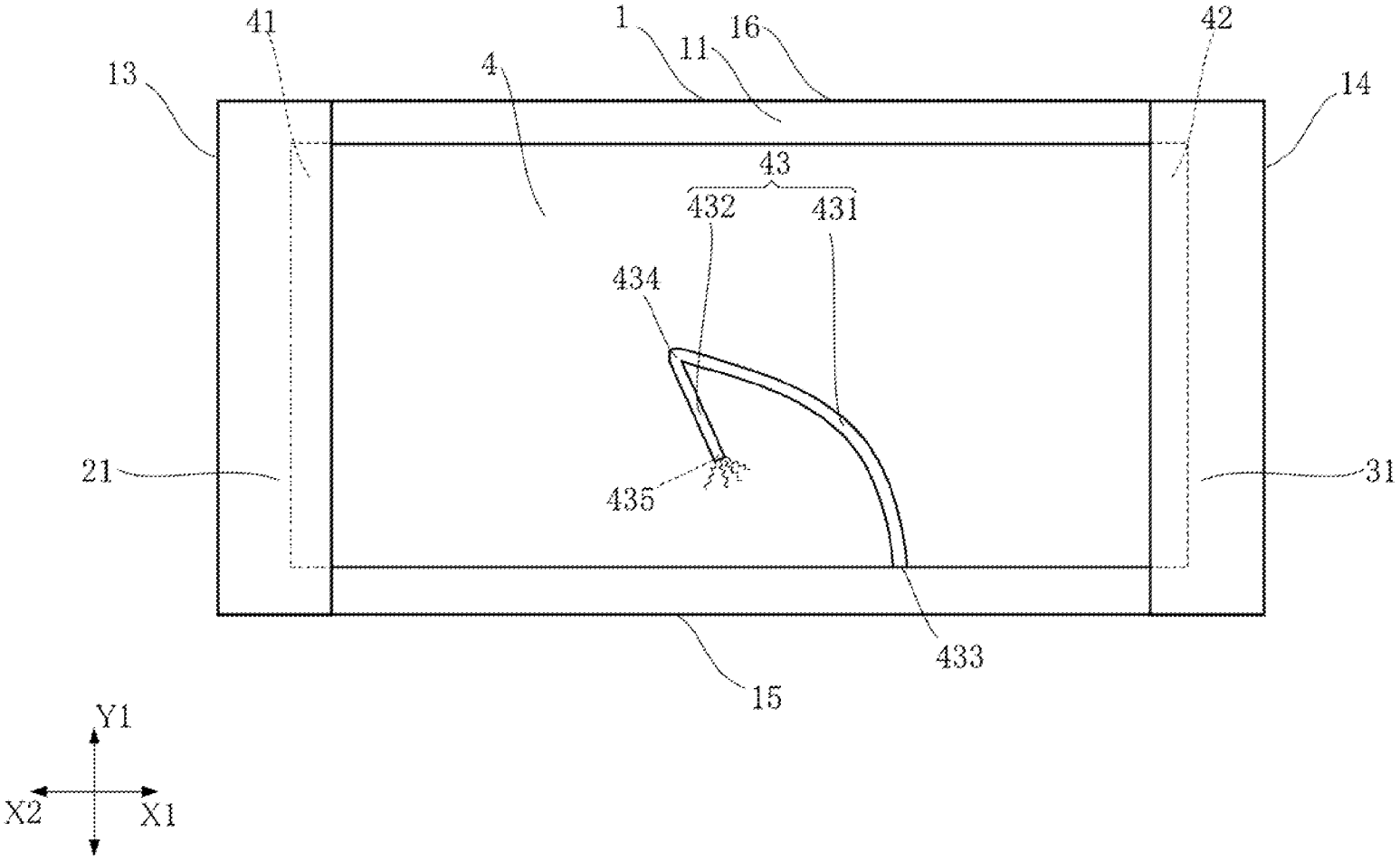
FIG. 12 is a plan view showing a variation of chip resistor (with some elements omitted) according to an embodiment of the present invention.
Figure 13:
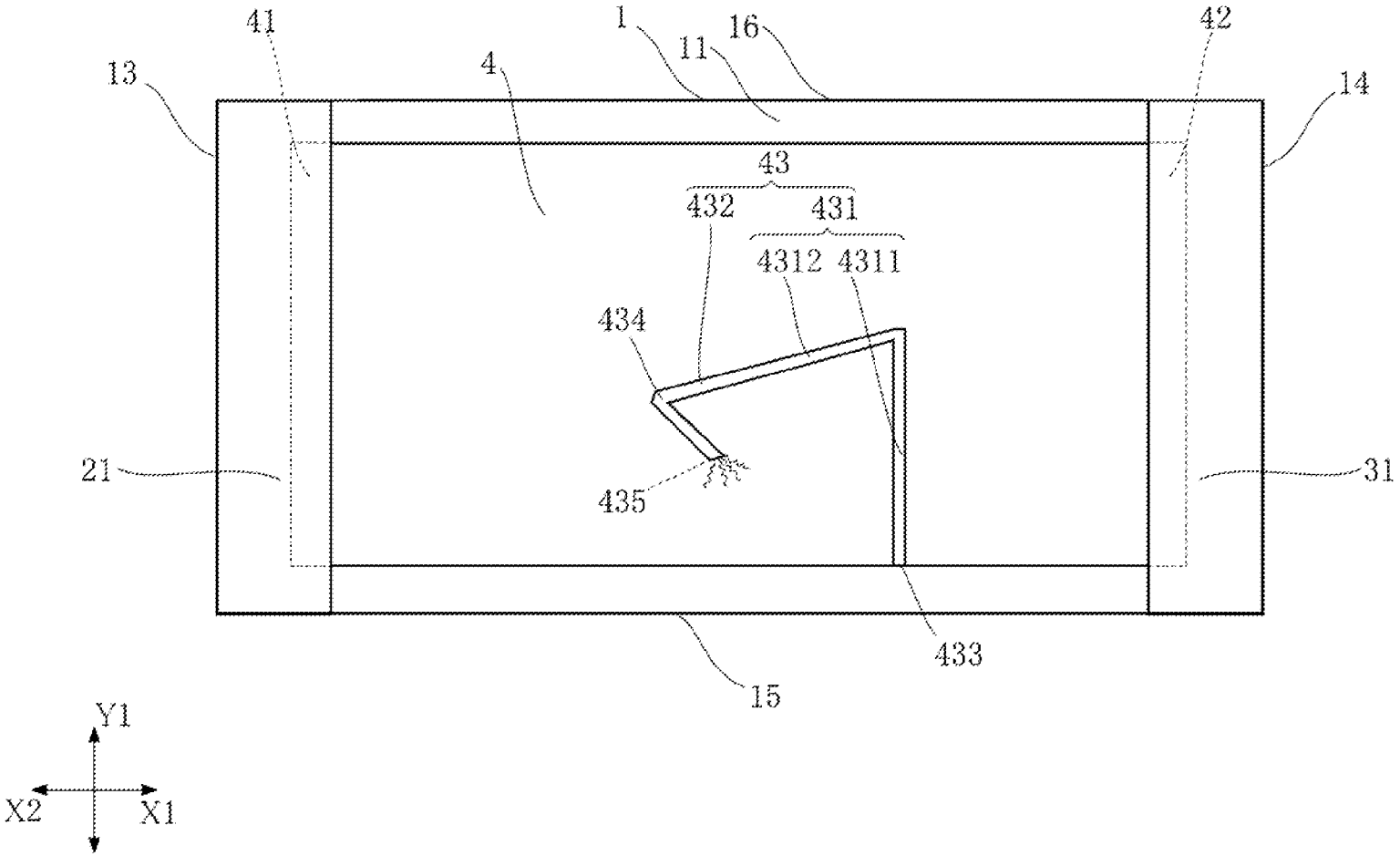
FIG. 13 is a plan view showing a variation of chip resistor (with some elements omitted) according to an embodiment of the present invention.

According to the present invention, the form of the main section 431 is not limited to the L-shaped form shown in FIG. 4, but may be a curved form, as shown in FIG. 12. As shown in FIG. 13, the second straight portion 4312 may bend at an angle of less than 90° with respect to the first straight portion 4311. According to the present invention, the path of the main section 431 is not limited to that of the illustrated examples as long as the section 431 extends continuously from the initial point 433 to the midway point 434.

Advantages of the above embodiment is described below.

In the above-described chip resistor 100, the resistive element 4 is formed on the main surface 11 of the base member 1, and then the first inner electrode 21 and the second inner electrode 31 are formed in a manner such that they overlap upper surfaces of the ends of the resistive element 4, respectively. In that manner, the entirety of the resistive element 4 can be formed directly on the flat main surface 11. Accordingly, the length and position of the resistive element 4 to be formed can be controlled precisely. Hence, the resistive element 4 can be formed to have as large an area as possible within the given size of the main surface 11. Further, in the present embodiment, the length L5 (the length of the part overlapping the upper part of the resistive element 4) of the first inner electrode 21 and the second inner electrode 31 is shortened intentionally. Thus, the effective length L3 of the resistive element 4 can be lengthened on the main surface 11 of the base member 1.

In the trimming groove 43 in the present embodiment, the additional section 432 is configured to start from the tip (i.e., the midway point 434) and extend in a direction going toward where the initial point 433 is located. Generally, micro-cracks will occur at the ending point of a trimming groove. In the present embodiment, microcracks may occur, as shown in FIG. 4, at the ending point 435 in a fanning-out manner. If such microcracks overlap the current path in the resistive element 4, the resultant product may fail to have the desired resistance value, and also the anti-surge properties may deteriorate. In the chip resistor 100 of the present embodiment, on the other hand, even if microcracks occur at the ending point of the trimming groove 43, the possibility that those cracks adversely affect the current path in the resistive element 4 is remarkably low.

As noted above, in the chip resistor 100 of the present embodiment, the effective length of the resistive element 4 can be long enough even if on the main surface 11 of the base member 1, which may be small. Further, it is advantageous that the possibility of adversely affecting the current path in the resistive element 4 by the microcracks at the ending point of the trimming groove 43 can be remarkably lowered. Due to the double advantages noted above, the anti-surge properties of the chip resistor 100 can be improved.

The invention claimed is:

1. A chip resistor comprising:

a base member including an obverse surface and a reverse surface opposite to the obverse surface, the base member also including a first side surface and a second side surface spaced apart from each other in a first direction;

a resistive element formed on the obverse surface and including a first end portion and a second end portion spaced apart from each other in the first direction;

a first inner electrode formed on the obverse surface and held in contact with the first end portion of the resistive element;

a second inner electrode formed on the obverse surface and held in contact with the second end portion of the resistive element;

a first reverse surface electrode formed on the reverse surface and reaching the first side surface of the base member; and a second reverse surface electrode formed on the reverse surface and spaced apart from the first reverse surface, the second reverse surface electrode reaching the second side surface of the base member;

wherein a length of each of the first reverse surface electrode and the second reverse surface electrode measured in the first direction is in a range of 2/10 to 3/10 of a length of the base member measured in the first direction, and said length of each of the first reverse surface electrode and the second reverse surface electrode is greater than a length of each of the first inner electrode and the second inner electrode measured in the first direction, each of the first end portion and the second end portion of the resistive element has a curved upper surface, the first inner electrode being in contact with the curved upper surface of the first end portion, the second inner electrode being in contact with the curved upper surface of the second end portion, and the first inner electrode reaches the first side surface of the base member, and the second inner electrode reaches the second side surface of the base member.

2. The chip resistor according to claim 1, wherein the first inner electrode includes a part overlapping on the first end portion of the resistive element such that a length of said part of the first inner electrode measured in the first direction is not greater than 1/14 of a length of the resistive element measured in the first direction, and the second inner electrode includes a part overlapping on the second end portion of the resistive element such that a length of said part of the second inner electrode measured in the first direction is not greater than 1/14 of the length of the resistive element measured in the first direction.

3. The chip resistor according to claim 1, wherein the first inner electrode includes both a part overlapping on the first end portion of the resistive element and a remaining part, a length of the remaining part measured in the first direction being not greater than 1/16 of the length of the base member measured in the first direction, and wherein the second inner electrode includes both a part overlapping on the second end portion of the resistive element and a remaining part, a length of the remaining part of the second inner electrode measured in the first direction being not greater than 1/16 of the length of the base member measured in the first direction.

4. The chip resistor according to claim 3, wherein the resistive element has a width measured in a second direction perpendicular to the first direction is in a range of 1/2 to 9/10 of a width of the obverse surface measured in the second direction.

5. The chip resistor according to claim 1, further comprising an undercoat covering the resistive element.

6. The chip resistor according to claim 5, further comprising an overcoat covering the undercoat.

7. The chip resistor according to claim 6, further comprising a first groundwork electrode and a second groundwork electrode each held in contact with the overcoat, wherein the first groundwork electrode covers the first inner electrode, and the second groundwork electrode covers the second inner electrode.

8. The chip resistor according to claim 7, wherein the first groundwork electrode being formed on the first side surface, the second groundwork electrode being formed on the second side surface.

9. The chip resistor according to claim 8, wherein the first reverse surface electrode is electrically connected to the first groundwork electrode, and the second reverse surface electrode is electrically connected to the second groundwork electrode.

10. The chip resistor according to claim 9, further comprising a first plating electrode and a second plating electrode, wherein the first plating electrode covers the first groundwork electrode and the first reverse surface electrode, and the second plating electrode covers the second groundwork electrode and the second reverse surface electrode.

11. The chip resistor according to claim 1, wherein the length of the base member measured in the first direction is in a range of 1.0 to 3.2 mm, and a width of the base member measured in a second direction perpendicular to the first direction is in a range of 0.5 to 2.5 mm.

12. The chip resistor according to claim 11, wherein the resistive element is formed with a trimming groove.

13. The chip resistor according to claim 12, wherein the trimming groove includes a main portion and an additional portion, wherein the main portion extends from an initial point to a midway point, the initial point being set at an edge of the resistive element, the midway point being offset with respect to the initial point in both the first direction and the second direction, and wherein the additional portion extends from the midway point to an ending point that is offset from the midway point toward the initial point in the second direction.

14. The chip resistor according to claim 13, wherein the additional portion extends at an angle of not greater than 90° with respect to the main portion.

15. The chip resistor according to claim 13, wherein the main portion has an L-shaped form that includes a first portion extending from the initial point in the second direction, and a second portion extending from an end of the first portion in the first direction.

* * * * *